United States Patent [19]

Price

[11] Patent Number: 5,053,169

[45] Date of Patent: Oct. 1, 1991

[54] METHOD FOR REFINING WAX ESTERS USING AMORPHOUS SILICA

[75] Inventor: Alonzo L. Price, Baltimore, Md.

[73] Assignee: W. R. Grace & Co.-Conn., New York, N.Y.

[21] Appl. No.: 390,799

[22] Filed: Aug. 8, 1989

[51] Int. Cl.[5] ..... C11B 11/00

[52] U.S. Cl. ..... 260/428

[58] Field of Search ..... 260/428

[56] References Cited

U.S. PATENT DOCUMENTS

| | | | |
|---|---|---|---|
| 4,607,011 | 8/1986 | Kaplan et al. | 260/428 |
| 4,629,588 | 12/1986 | Welsh et al. | 260/428 |
| 4,734,226 | 3/1988 | Parker et al. | 260/428 |
| 4,781,864 | 11/1989 | Pryor et al. | 260/428 |
| 4,812,436 | 3/1989 | Staal et al. | 260/428 |
| 4,874,629 | 10/1989 | Chang et al. | 260/428 |

FOREIGN PATENT DOCUMENTS

| | | | |
|---|---|---|---|
| 0671113 | 4/1952 | United Kingdom | 260/428 |

OTHER PUBLICATIONS

Parkinson, "Producers Aim at New Markets for Jojoba", *Chemical Week*, pp. 20–21 (Aug. 26, 1987).

*Primary Examiner*—Jose G. Dees
*Assistant Examiner*—Deborah D. Cair
*Attorney, Agent, or Firm*—Jill H. Krafte

[57] ABSTRACT

Adsorbents comprising amorphous silicas with effective average pore diameters of about 20 to about 5000 Angstroms are useful in processes for the removal of trace contaminants, specifically phospholipids and associated metal ions, and chlorophyll A, from wax ester, e.g., jojoba oil.

23 Claims, No Drawings

METHOD FOR REFINING WAX ESTERS USING AMORPHOUS SILICA

BACKGROUND OF THE INVENTION

This invention relates to a method for refining wax esters by contacting them with an adsorbent capable of selectively removing trace contaminants. Jojoba oil is a commercially important wax ester which can be treated by this method. More specifically, it has been found that amorphous silicas of suitable porosity are quite effective in adsorbing phospholipids and associated metal-containing species from wax esters, to produce products with substantially lowered concentrations of these trace contaminants.

Jojoba oil is an odorless fatty alcohol ester, light gold in color. It consists of practically 100% linear wax esters, about 87% of which are combinations of straight-chain acids and alcohols. Jojoba oil is not derived from glycerol and is not a glyceride oil as are most plant seed oils. Jojoba is used primarily as an emollient in certain cosmetics, such as skin care preparations. Jojoba also is used as an additive for high-temperature or high-pressure lubricants, as well as an antifoam agent. The oil may be useful in some edible oil markets such as for cooking and salad oils.

Jojoba oil is produced from an evergreen desert shrub, with the oil obtained from the seeds of the plant by mechanical expression or solvent extraction techniques, or both. Extraction with hexane is typical. The expressed or extracted product is then ready for the bleaching operation which removes phospholipids, trace metals and color pigments. Bleaching earths have been used historically for this operaiton. Most commonly, acid-activated clay has been used in the bleaching step.

For most applications, the phosphorus content of jojoba oil must be reduced to prevent cloudiness. Phosphorus, present as phospholipids, tends to impart off colors, odors and flavors to the finish oil product and is therefore removed. Metal-containing species associated with phospholipids (i.e., iron, copper, calcium and magnesium) also are removed since they tend to promote oxidation. Clay adsorbents have been used for removal of phospholipids and trace metals, but their use results in removal of natural antioxidants as well and the treated jojoba oil tends to lose its naturally excellent oxidative stability. Moreover, significant quantities of oil are lost in clay filter cakes. In processing jojoba oil, which is a relatively expensive oil, these losses are quite costly.

Amorphous silicas previously have been used in the purification of glyceride oils. For example, U.S. Pat. No. 4,629,588 (Welsh et al.) discloses the use of amorphous silica adsorbents for the removal of phospholipids and associated metal ions from glyceride oils. Glyceride oils, typically vegetable oils, are comprised of esters of glycerol and fatty acids in which one, two or three hydroxyl groups of the glycerol have been replaced by acid radicals.

As disclosed herein, it now has been found that amorphous silicas are effective in the refining of wax esters such as jojoba oil. The process described here efficiently and satisfactorily removes phospholipids and metal ions from the wax ester jojoba oil, and also reduces chlorophyll A levels. Amorphous silica alone has not been demonstrated to be effective for removal of chlorophyll A from glyceride oils.

SUMMARY OF THE INVENTION

Trace contaminants, such as phospholipids and associated metal ions, can be removed effectively from wax esters, such as jojoba oil, by adsorption onto amorphous silica. This adsorption process simultaneously removes chlorophyll A as well. The process described herein utilizes amorphous silicas having an average pore diameter of between about 20 A and about 5000 A. Further, it has been observed that the presence of water in the pores of the silica greatly improves the filterability of the adsorbent from the wax ester.

Key objects of this invention are both to provide a method for reducing the phospholipid content of jojoba oil and other wax esters to acceptable levels and also to provide adsorbents which have higher capacities than clay for phospholipids and trace metals. A further object is to reduce chlorophyll A levels. Adsorption of phospholipids and associated contaminants onto amorphous silica in the manner described can reduce or eliminate any need to use clays or bleaching earth, particularly in applications in which red or yellow coloring is not important. Elimination of the bleaching earth step or reduction in bleaching earth quantities will result in substantial oil conservation as this step typically results in significant oil loss with conventional refining methods. Moreover, since spent bleaching earth has a tendency to undergo spontaneous combustion, reduction or elimination of this step will yield an occupationally and environmentally safer process.

It is also an object to provide a bleaching adsorbent and process which do not result in the stripping of natural antioxidants from the wax ester, or in chemical reactions whose products may be detrimental to the wax ester. A related object is to selectively remove from the ester compounds which may cause or trigger oxidation.

DETAILED DESCRIPTION OF THE INVENTION

It has been found that certain amorphous silicas are particularly well suited for removing trace contaminants, specifically phospholipids and associated metal ions, as well as chlorophyll A, from wax esters. The process for the removal of these trace contaminants, as described in detail herein, essentially comprises the steps of selecting an adsorbent comprising an amorphous silica, contacting a wax ester with the adsorbent, allowing the phospholipids and associated metal ions to be adsorbed, and separating the resulting phospholipid- and metal ion-depleted ester from the adsorbent. Suitable amorphous silicas for this process are those with pore diameters greater than 20 A. In addition, silicas with a moisture content of greater than about 25% by weight exhibit improved filterability from the oil and are therefore preferred.

Removal of phospholipids from jojoba oils is a significant step in the oil refining process because residual phosphorus can cause off colors, odors and flavors in the finished oil. Phosphorus levels in pressed or extracted jojoba oil are typically about 10 to about 20 ppm. The acceptable concentration of phosphorus in the finished oil product should be less than about 5.0 ppm, preferably less than about 1.0 ppm, according to general industry practice.

In addition to phospholipid removal, the process of this invention also removes from jojoba oil ionic forms of the metals calcium, magnesium, iron and copper, which are believed to be chemically associated with phospholipids. These metal ions themselves have a deleterious effect on the refined oil products. Calcium and magnesium ions can result in the formation of precipitates. The presence of iron and copper ions promote oxidative instability. Throughout the description of this invention, unless otherwise indicated, reference to the removal of phospholipids is meant to encompass the removal of associated trace contaminants as well.

Still further, the process described herein is effective for removing chlorophyll A from the wax ester. The resulting reduction of green coloration is desired for marketing purposes. Clay or bleaching earth was previously used for decolorization.

The term "amorphous silica" as used herein is intended to embrace silica gels, precipitated silicas, dialytic silicas and fumed silicas in their various prepared or activated forms. Both silica gels and precipitated silicas are prepared by the destabilization of aqueous silicate solutions by acid neutralization. In the preparation of silica gel, a silica hydrogel is formed which then typically is washed to low salt content. The washed hydrogel may be milled as a hydrogel having a moisture content of about 60 to 70 wt %, or may be dried prior to milling. If the gel is dried to the point where its structure no longer changes as a result of shrinkage, that dried, stable silica is termed a xerogel. In the preparation of precipitated silicas, the destabilization is carried out in the presence of polymerization inhibitors, such as inorganic salts, which cause precipitation of hydrated silica. The precipitate typically is filtered, washed and dried. For preparation of gels or precipitates useful in this invention, it is preferred to dry them and then to add water to reach the desired water content before use. However, it is possible to initially dry the gel or precipitate to the desired water content. Dialytic silica is prepared by precipitation of silica from a soluble silicate solution containing electrolyte salts (e.g., $NaNO_3$, $Na_2SO_4$, $KNO_3$) while electrodialyzing, as described in pending U.S. patent application Ser. No. 533,206 (Winyall), "Particulate Dialytic Silica," filed Sept. 20, 1983. Fumed silicas (or pyrogenic silicas) are prepared from silicon tetrachloride by high-temperature hydrolysis, or other convenient methods. The specific manufacturing process used to prepare the amorphous silica is not expected to affect its utility in this method.

In the preferred embodiment of this invention, the silica adsorbent will have sufficient porosity to permit access to the phospholipid molecules, while being capable of maintaining good structural integrity upon contact with an aqueous media. The requirement of structural integrity is particularly important where the silica adsorbents are used in continuous flow systems, which are susceptible to disruption and plugging. Amorphous silicas suitable for use in this process have surface areas of up to about 1200 square meters per gram, preferably between 100 and 1200 square meters per gram. It is preferred, as well, for as much as possible of the surface area to be contained in pores with diameters greater than 50 A, although partially dried hydrogels with average pore diameters of about 20 to about 50 A and a moisture content of at least about 25 wt % may be used.

The method of this invention therefore utilizes amorphous silicas with substantial porosity contained in pores having diameters greater than about 20 A, as defined herein, after appropriate activation. Activation typically is by heating to temperatures of about 450° to 700° F. in vacuum. One convention which describes silicas is average pore diameter ("APD"), typically defined as that pore diameter at which 50% of the surface area or pore volume is contained in pores with diameters greater than the stated APD and 50% is contained in pores with diameters less than the stated APD. Thus, in amorphous silicas preferable for use in the method of this invention, at least 50% of the pore volume will be in pores of at least 20 A diameter. Silicas with a higher proportion of pores with diameters greater than 20 A will be preferred, as these will contain a greater number of potential adsorption sites. The practical upper APD limit is about 5000 A.

Silicas which have measured intraparticle APDs within the stated range will be suitable for use in this process. Alternatively, the preferred porosity may be achieved by the creation of an artificial pore network of interparticle voids in the 20 A to 5000 A range. For example, non-porous silicas (i.e., fumed silica) can be used as aggregated particles. Silicas, with or without the required porosity, may be used under conditions which create this artificial pore network. Thus it is preferred to select amorphous silicas for use in this process which have an "effective average pore diameter" greater than 20 A. This term includes both measured intraparticle APD and interparticle APD, designating the pores created by aggregation or packing of silica particles.

The APD value (in Angstroms) can be measured by several methods or can be approximated by the following equation, which assumes model pores of cylindrical geometry:

$$APD\ (A) = \frac{40{,}000 \times PV\ (\text{cc/gm})}{SA\ (\text{m}^2/\text{gm})}, \qquad (1)$$

where PV is pore volume (measured in cubic centimeters per gram) and SA is surface area (measured in square meters per gram).

Both nitrogen and mercury porosimetry may be used to measure pore volume in xerogels, precipitated silicas and dialytic silicas. Pore volume may be measured by the nitgrogen Brunauer-Emmett-Teller ("B-E-T") method described in Brunauer et al., J. Am. Chem. Soc., Vol 60, p. 309 (1938). This method depends on the condensation of nitrogen into the pores of activated silica and is useful for measuring pores with diameters up to about 600 A. If the sample contains pores with diameters greater than about 600 A, the pore size distribution, at least of the larger pores, is determined by mercury porosimetry as described in Ritter et al., Ind. Eng. Chem. Anal. Ed. 17, 787 (1945). This method is based on determining the pressure required to force mercury into the pores of the sample. Mercury porosimetry, which is useful from about 30 to about 10,000 A, may be used alone for measuring pore volumes in silicas having pores with diameters both above and below 600 A. Alternatively, nitrogen porosimetry can be used in conjunction with mercury porosimetry for these silicas. For measurement of APDs below 600 A, it may be desired to compare the results obtained by both methods. The calculated PV volume is used in Equation (1).

For determining pore volume of hydrogels or partially dried hydrogels, a different procedure, which assumes a direct relationship between pore volume and water content, is used. A sample of the hydrogel is weighed into a container and all water is removed from the sample by vacuum at low temperatures (i.e., about room temperature). The sample is then heated to about 450° to 700° F. to activate. After activation, the sample is re-weighed to determine the weight of the silica on a dry basis, and the pore volume is calculated by the equation:

$$PV\,(\text{cc/gm}) = \frac{\%\ TV}{100 - \%\ TV},$$

where TV is total volatiles, determined by the wet and dry weight differential. The PV value calculated in this manner is then used in Equation (1).

It is quite possible that the moisture and salts content of a partially dried hydrogel of this invention do not fill all of the available pore network. In addition, the milling process itself may create a secondary pore structure with measurable pore volume. To account for the void space which may be present in these partially dried hydrogels, the mercury pore volume of the adsorbent should be measured on an as is basis (that is, without drying and activating). The mercury pore volume then is added to the total volatiles pore volume. Mercury porosimetry is described in Ritter et al., Ind. Eng. Chem. Anal. Ed. 17, 787 (1945). This method, which is useful for measuring pores with diameters about 30 A or above, is based on determining the pressure required to force mercury into the pores of the sample. Alternatively, the nitrogen pore volume of the partially dried hydrogel may be measured by the B-E-T method described below, and that value may be used in Equation (1) to calculate APD. The highest measured pore volume normally will be used in Equation (1) to calculate the APD.

The surface area measurement in the APD equation is measured by the nitrogen B-E-T surface area method, described in the Brunauer et al., article, supra. The surface area of all types of appropriately activated amorphous silicas can be measured by this method. The measured SA is used in Equation (1) with the measured PV to calculate the APD of the silica.

In the preferred embodiment of this invention, the amorphous silica selected for use will be a hydrogel. The characteristics of hydrogels are such that they effectively adsorb trace contaminants from glyceride oils and that they exhibit superior filterability as compared with other forms of silica. The selection of hydrogels therefore will facilitate the overall refining process.

The purity of the amorphous silica used in this invention is not believed to be critical in terms of the adsorption of phospholipids. However, where the finished products are intended to be food grade wax esters care should be taken to ensure that the silica used does not contain leachable impurities which could compromise the desired purity of the product(s). It is preferred, therefore, to use a substantially pure amorphous silica, although minor amounts, i.e., less than about 10%, of other inorganic constituents may be present. For example, suitable silicas may comprise iron as $Fe_2O_3$, aluminum as $Al_2O_3$, titanium as $TiO_2$, calcium as CaO, sodium as $Na_2O$, zirconium as $ZrO_2$, and/or trace elements.

It has been found that the moisture or water content of the silica has an important effect on the filterability of the silica from the wax ester. The presence of greater than 30% by weight of water in the pores of the silica (measured as weight loss on ignition at 1750° F) is preferred for improved filterability. This improvement in filterability is observed even at elevated wax ester temperatures which would tend to cause the water content of the silica to be substantially lost by evaporation during the treatment step.

The adsorption step itself is accomplished by conventional contacting methods in which the amorphous silica and the wax ester are contacted, preferably in a manner which facilitates the adsorption. The adsorption step may be by any convenient batch or continuous process. In any case, agitation or other mixing will enhance the adsorption efficiency of the silica.

The adsorption can be conducted at any convenient temperature at which the wax ester is a liquid. The wax ester and amorphous silica are contacted as described above for a period sufficient to achieve the desired phospholipid content in the treated ester. The specific contact time will vary somewhat with the selected process, i.e., batch or continuous. In addition, the adsorbent usage, that is, the relative quantity of adsorbent brought into contact with the wax ester, will affect the amount of phospholipids removed. The adsorbent usage is quantified as the weight percent of amorphous silica (on a dry weight basis after ignition at 1750° F.), calculated on the weight of the wax ester processed. The preferred adsorbent usage is about 0.01 to about 2.0%, preferably about 1.0%. The usage will depend on the level of trace contaminants to be removed.

As seen in the Examples, significant reduction in phospholipid content is achieved by the method of this invention. The specific phosphorus content of the treated wax ester will depend primarily on the wax ester itself, as well as on the silica, usage, process, etc. However, phosphorus levels of less than 10.0 ppm, preferably less than 5.0 ppm, and most preferably less than 1.0 ppm, can be achieved. Trace metals are also reduced, as is the level of chlorophyll A.

Following adsorption, the phospholipid-enriched silica is filtered from the phospholipid-depleted wax ester by any convenient filtration means. The wax ester may be subjected to additional finishing processes, such as steam refining, heat bleaching and/or deodorizing. The method described herein may reduce the phosphorus and chlorophyll levels sufficiently to eliminate the need for bleaching earth steps. However, it may be desired to treat the wax ester with both amorphous silica and bleaching earth.

Where bleaching earth operations are to be employed for decoloration, simultaneous addition or sequential treatment with amorphous silica and bleaching earth provides an extremely efficient overall process. By using both adsorbents together or by first using the method of this invention to decrease the phospholipid content, and then treating with bleaching earth, the latter step is made to be more effective. The bleaching earth can be utilized very effectively in a packed bed following pretreatment with the amorphous silica. Preferably, at least about 50% of the bleaching earth is in a packed bed. It can be seen that either the quantity of bleaching earth required can be significantly reduced, or the bleaching earth will operate more effectively per unit weight. It may be feasible to elute the adsorbed contaminants from the spent silica in order to re-cycle the silica for further wax ester treatment.

The examples which follow are given for illustrative purposes and are not meant to limit the invention described herein. The following abbreviations have been used throughout in describing the invention.

A — Angstrom(s)
APD — average pore diameter
B-E-T — Brunauer-Emmett-Teller
Ca — calcium
cc — cubic centimeter(s)
Chl A — chlorophyll A
cm — centimeter
Cu — copper
° C. — degrees Centigrade
° F. — degrees Fahrenheit
Fe — iron
gm — gram(s)
ICP — Inductively Coupled Plasma
m — meter
Mg — magnesium
P — phosphorus
ppm — parts per million
% — percent
PV — pore volume
SA — surface area
TV — total volatiles
wt — weight

EXAMPLE I (Amorphous Silicas and Jojoba Oil)

The silicas used in the following Examples are listed in Table I, together with their relevant properties. Silica A is TriSyl 300 TM amorphous silica available from the Davison Division of W. R. Grace & Co. Conn. Silica B is TriSyl TM amorphous silica, also available from Davison. The characteristics of the single pressed jojoba oil, as analyzed by inductively coupled plasma ("ICP") emission spectroscopy are shown in Table II.

TABLE I

| | (Amorphous Silicas) | | | |
|---|---|---|---|---|
| Silica Sample | Surface Area[1] | Pore Volume[2] | Av. Pore Diameter[3] | Total Volatiles[4] |
| A | 901 | 1.27 | 57 | 65.0 |
| B | 871 | 0.96 | 45 | 65.0 |

[1]B-E-T surface area (SA) measured as described above.
[2]Pore volume (PV) measured as described above using nitrogen porosimetry for xerogels and precipitates, hydrogel method as described, and for dialytic silicas using mercury porosimetry and selecting average pore diameter at the peak observed in a plot of d(Volume)/d (log Diameter) vs. log Pore Diameter.
[3]Average pore diameter (APD) calculated as described above.
[4]Total volatiles, in wt. %, on ignition at 1750° F.

TABLE II

| (Single Pressed Jojoba Oil) Trace Contaminant Levels (ppm)[1] | | | | |
|---|---|---|---|---|
| P | Cu[2] | Ca | Mg | Fe |
| 10.2 | 0.00 | 4.27 | 3.48 | 0.137 |

[1]Trace contaminant levels measured in parts per million versus standards by ICP emission spectroscopy.
[2]Copper values reported were near the detection limits of this analytical technique.

EXAMPLE II

The single pressed jojoba oil of Table II was treated with the silicas listed in Table I. For each test, a volume of Oil A was preheated to 70° C. and the test silica was added in the amount indicated in the second column of Table III. The mixture was agitated vigorously for 20 minutes, then heated to 100° C. and agitated vigorously for an additional 30 minutes. The silica was separated from the oil by filtration. The treated, filtered oil samples were analyzed for trace contaminant levels (in ppm) by ICP emission spectroscopy. The results, shown in Table III, demonstrate the effectiveness of the silica samples in removing phospholipids and trace metals from this oil.

TABLE III

| | | Trace Contaminant Levels (ppm)[3] | | | | |
|---|---|---|---|---|---|---|
| Silica[1] | Adsorbent Dosage, wt %[2] | P | Cu[4] | Ca | Mg | Fe |
| A | 0.5 | 0.172 | 0.075 | 0.179 | 0.119 | 0.00 |
| | 1.00 | 0.803 | 0.00 | 0.321 | 0.386 | 0.00 |
| | 1.50 | 0.00 | 0.00 | 0.00 | 0.062 | 0.00 |
| | 2.00 | 0.216 | 0.019 | 0.024 | 0.105 | 0.00 |
| B | 0.5 | 1.97 | 0.00 | 1.12 | 0.890 | 0.00 |
| | 1.00 | 0.139 | 0.002 | 0.327 | 0.168 | 0.00 |
| | 1.50 | 0.887 | 0.00 | 0.681 | 0.473 | 0.00 |
| | 2.00 | 0.583 | 0.005 | 0.451 | 0.345 | 0.007 |

[1]Silica numbers refer to those listed in Table I.
[2]Adsorbent usage is weight % of silica (on a dry basis at 1750° F.) in the oil sample.
[3]Trace contaminant levels measured versus standards by ICP mission spectroscopy.
[4]Copper values reported were near the detection limits of this analytical technique.

EXAMPLE III

The jojoba oil of Table II was treated with Silicas A and B to determine their effect on oil color. The procedures of Example II were repeated. The results are shown in Table IV.

TABLE IV

| Silica | Adsorbent Dosage, wt % | Red/Yellow[1] | Chl A[1] |
|---|---|---|---|
| Control | — | 6.6/70+ | .20 |
| A | 0.5 | 7.0/70+ | .08 |
| | 1.0 | 7.0/70+ | .11 |
| | 1.5 | 6.3/70+ | .03 |
| | 2.0 | 7.1/70+ | .00 |
| B | 0.5 | 6.2/70+ | .12 |
| | 1.0 | 6.0/70+ | .09 |
| | 1.5 | 5.8/70+ | .06 |
| | 2.0 | 6.0/70+ | .06 |

[1]Red, yellow and chlorophyll color values were determined by using a Lovibond TM Tintometer TM AF960 color apparatus (The Tintometer Company).

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

I claim:

1. A sequential treatment process for decreasing the phospholipid content of and decolorizing wax esters, comprising first treating said wax ester by contacting with amorphous silica having an effective average pore diameter of about 20 to 5000 Angstroms and next treating the phospholipid-depleted wax ester with bleaching earth.

2. The process of claim 1 in which said silica is substantially removed from said wax ester before contacting the ester with said bleaching earth.

3. The process of claim 2 in which at least a portion of said bleaching earth is in a packed bed.

4. The process of claim 3 in which at least about 50% of said bleaching earth is in a packed bed.

5. A sequential treatment process for decreasing the phospholipid content of and decolorizing wax esters, comprising first treating said wax ester by contacting with bleaching earth and then treating with amorphous silica having an effective average pore diameter of about 20 to 5000 Angstroms.

6. A process for the removal of trace contaminants, specifically phospholipids and associated metal ions, and chlorophyll a, from wax esters by adsorbing said trace contaminants onto amorphous silica, comprising:

(a) selecting a wax ester with a phosphorus content in excess of about 1.0 ppm, (b) contacting the wax ester of step (a) with amorphous silica, (c) allowing said trace contaminants to be adsorbed onto said amorphous silica, and (d) separating the resulting phospholipid-, chlorophyll a, and metal ion-depleted wax ester from the amorphous silica.

7. The process of claim 1 in which said wax ester comprises up to about 20.0 parts per million phosphorus.

8. The process of claim 1 in which said wax ester is jojoba oil.

9. The process of claim 1 in which said silica is substantially pure amorphous silica.

10. The process of claim 1 in which said amorphous silica has an effective average pore diameter of greater than about 20 Angstroms.

11. The process of claim 10 in which said average pore diameter is between about 20 and about 5000 Angstroms.

12. The process of claim 11 in which said average pore diameter is between about 50 and about 5000 Angstroms.

13. The process of claim 11 in which said amorphous silica is a partially dried hydrogel with a moisture content of at least about 25 wt % and an average pore diameter of about 20 to about 50 Angstroms.

14. The process of claim 1 in which said amorphous silica is utilized in such a manner as to create an artificial pore network of interparticle voids having diameters of about 20 to about 5000 Angstroms.

15. The process of claim 1 in which said amorphous silica is selected from the group consisting of silica gels, precipitated silicas, dialytic silicas, and fumed silicas.

16. The process of claim 5 in which said silica gel is a hydrogel.

17. The process of claim 5 in which the water content of said amorphous silica is greater than 25% by weight.

18. The process of claim 1 in which said amorphous silica has a surface area of up to about 1200 square meters per gram.

19. The process of claim 1 in which said amorphous silica comprises minor amounts of inorganic constituents.

20. The process of claim 1 in which said silica contains less than about 10% of other organic constituents.

21. The process of claim 1 in which the phospholipid-depleted wax ester of step (e) has commercially acceptable levels of phospholipid.

22. The process of claim 21 in which the phospholipid-depleted wax ester of step (e) has a phosphorus content of less than about 15.0 parts per million.

23. The process of claim 22 in which said phosphorus content is less than about 1.0 parts per million.

* * * * *

UNITED STATES PATENT AND TRADEMARK OFFICE

CERTIFICATE OF CORRECTION

PATENT NO. : 5,053,169

DATED : October 1, 1991

INVENTOR(S) : Alonzo L. Price

It is certified that error appears in the above-identified patent and that said Letters Patent is hereby corrected as shown below:

Claim 6, col. 9, lines 5 and 14: "chlorophyll a" should be --chlororphyll A--.

Claim 7, col. 9, line 16: "claim 1" should be --claim 6--.

Claim 8, col. 9, line 19: "claim 1" should be --claim 6--.

Claim 9, col. 9, line 21: "claim 1" should be --claim 6--.

Claim 10, col. 9, line 23: "claim 1" should be --claim 6--.

Claim 14, col. 10, line 5: "claim 1" should be --claim 6--.

Claim 15, col. 10, line 9: "claim 1" should be --claim 6--.

Claim 16, col. 10, line 12: "claim 5" should be --claim 15--.

Claim 17, col. 10, line 14: "claim 5" should be --claim 15--.

Claim 18, col. 10, line 16: "claim 1" should be --claim 6--.

Claim 19, col. 10, line 19: "claim 1" should be --claim 6--.

Claim 20, col. 10, line 22: "claim 1" should be --claim 6--.

Claim 21, col. 10, line 24: "claim 1" should be --claim 6--.

Signed and Sealed this

Ninth Day of February, 1993

*Attest:*

STEPHEN G. KUNIN

*Attesting Officer*

*Acting Commissioner of Patents and Trademarks*